US005503311A

United States Patent [19]

Chen

[11] Patent Number: 5,503,311

[45] Date of Patent: Apr. 2, 1996

[54] ROTATING CLOTHES HANGER COVERED WITH A TOY DOLL

[76] Inventor: Chao-Yang Chen, 8F-3, No. 321, Fu Hsing S. Road, Sec. 1, Taipei, Taiwan

[21] Appl. No.: 456,310

[22] Filed: Jun. 1, 1995

[51] Int. Cl.[6] ..... A47G 25/14

[52] U.S. Cl. ..... 223/85; 223/92; 223/98; D6/315; 446/73; 446/330

[58] Field of Search ..... 223/85, 92, 88, 223/95, 98; D6/315; 211/113; 446/73, 330

[56] References Cited

U.S. PATENT DOCUMENTS

| | | | |
|---|---|---|---|
| D. 123,389 | 11/1940 | Dunlap | D6/315 |
| D. 123,392 | 11/1940 | Dunlap | D6/315 |
| D. 123,396 | 11/1940 | Dunlap | D6/315 |
| 4,615,447 | 10/1986 | Walter | 211/4 |
| 4,951,484 | 8/1990 | Rohald et al. | 223/85 |
| 5,201,443 | 4/1993 | Oswald | 223/85 |

FOREIGN PATENT DOCUMENTS

| | | | |
|---|---|---|---|
| 1299182 | 7/1961 | France | 223/94 |
| 2376675 | 1/1977 | France | 223/DIG. 4 |
| 2616143 | 10/1977 | Germany | 223/85 |
| 170349 | 2/1960 | Sweden | 223/DIG. 4 |
| 250620 | 9/1947 | Switzerland | 223/94 |
| 12804 | 6/1969 | Switzerland | 223/DIG. 4 |

*Primary Examiner*—C. D. Crowder
*Assistant Examiner*—Bibhu Mohanty
*Attorney, Agent, or Firm*—Bacon & Thomas

[57] ABSTRACT

A rotating clothes hanger including a hanger base having an upright coupling portion, a toy doll covered on the hanger base and having a hole for passing the upright coupling portion of the hanger base, a swivel hook rotatably coupled to the upright coupling portion of the hanger base by a ball and socket joint, and a cap mounted around the upright coupling portion to hold down the periphery of the hole on the toy doll.

5 Claims, 3 Drawing Sheets

ROTATING CLOTHES HANGER COVERED WITH A TOY DOLL

BACKGROUND OF THE INVENTION

The present invention relates to clothes hangers, and relates more particularly to a rotary clothes hanger covered with a toy doll.

A variety of devices have been developed for hanging clothes. Exemplars are seen in U.S. Pat. No. 4,889,246 entitled "Rotating Clothes Trees"; U.S. Pat. No. 5,062,536 entitled "Rotatable Hanger Assembly"; U.S. Pat. No. 5,167,564 entitled "Rotatable Hanger Assembly".

When a rotatable clothes hanger is covered with a toy doll for decoration, the periphery of the hole through which the swivel hook of the hanger extends to the outside tends to be ruptured, causing the stuffing (sponge, cotton, cloth strips, etc.) extended out of the covering of the toy doll to hinder the rotation of the swivel hook.

SUMMARY OF THE INVENTION

The present invention has been accomplished to provide a rotating clothes hanger which eliminates the aforesaid problem. According to one embodiment of the present invention, the rotating clothes hanger comprises a hanger base having an elongated horizontal rib and a cylindrical receptacle perpendicularly extended from the mid point of the horizontal rib and covered with a cap, a toy doll covered on the hanger base and having a hole at a top side thereof, a hook connector having a threaded cylindrical bolt inserted through the hole on the toy doll and fastened to a center mounting hole on the cap of the receptacle and a head stopped outside the cap of the receptacle to hold down the periphery of the hole on the toy doll, and a swivel hook having a straight mounting leg inserted through a longitudinal center through hole on the hook connector and a rounded tip at the end of the swivel hook stopped outside the hook connector within the receptacle.

According to another embodiment of the present invention, the rotating clothes hanger comprises a hanger base having a middle plate and a horizontal rib and a vertical rib perpendicularly extended from the mid point of horizontal rib and terminating in a ball, a toy doll covered on the hanger base and having a hole through which the upper part of the vertical rib extends out of the toy doll, a coupling cap around the upper part of the vertical rib(the top extension) and covered over the hole on the toy doll to hold down the periphery of the hole on the toy doll, and a swivel hook having a bottom end terminating in a ball socket coupled to the ball of the vertical rid of the hanger base.

DETAILED DESCRIPTION OF THE PREFERRED EMBODIMENT

Figure 1:
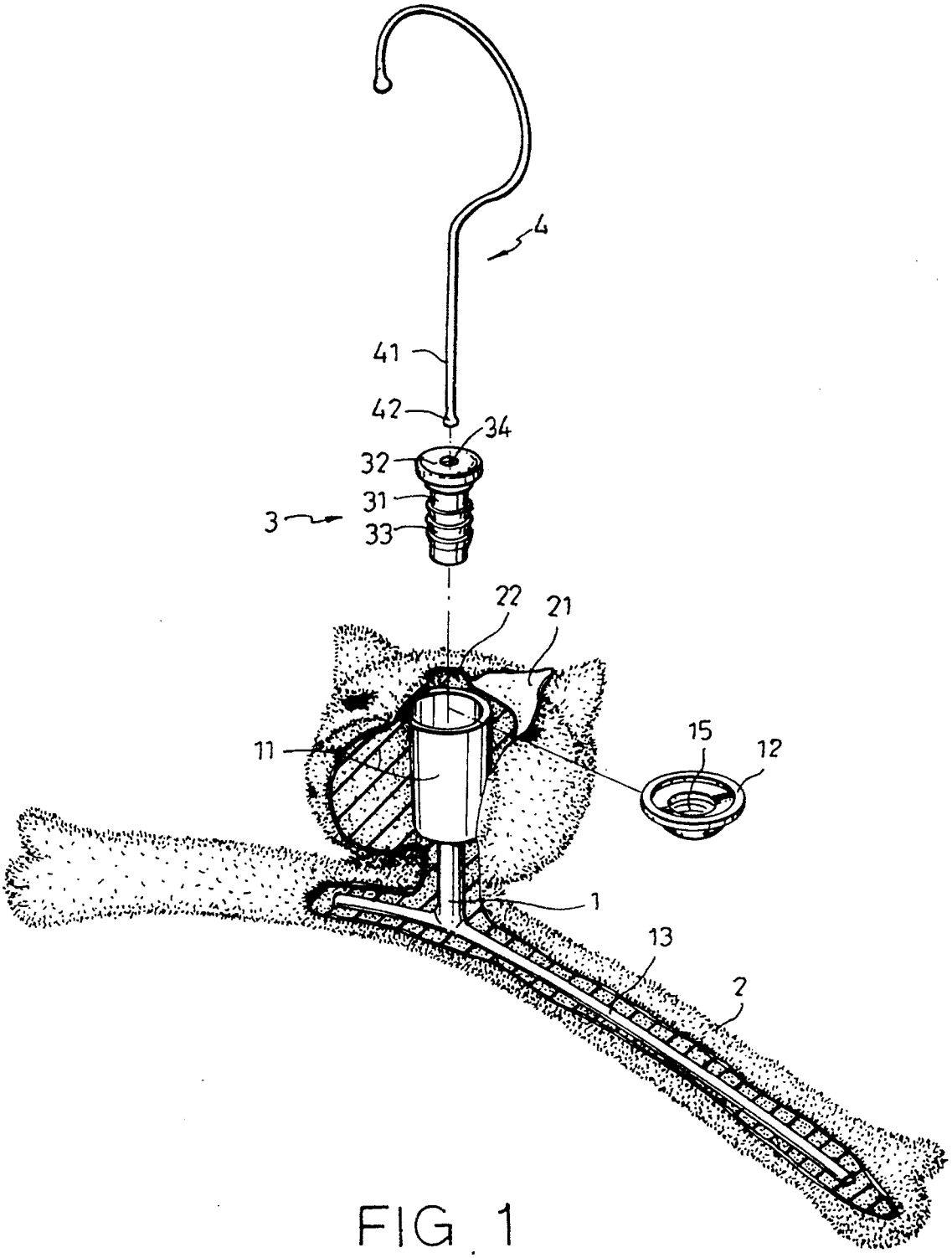
FIG. 1 is an exploded and partially cutaway view of a rotating clothes hanger according to one embodiment of the present invention.

Referring to FIG. 1, a rotating clothes hanger in accordance with the present invention is generally comprised of a hanger base 1, a toy doll 2 covered on the hanger base 1, a hook connector 3, and a swivel hook 4 rotatably connected to the hanger base 1 by the hook connector 3. The hanger base 1 comprises an elongated horizontal rib 13, a vertical cylindrical receptacle 11 perpendicularly extended from the mid point of the horizontal rib 13, and a cap 12 adhered to the receptacle 11 at the top.

Figure 2:
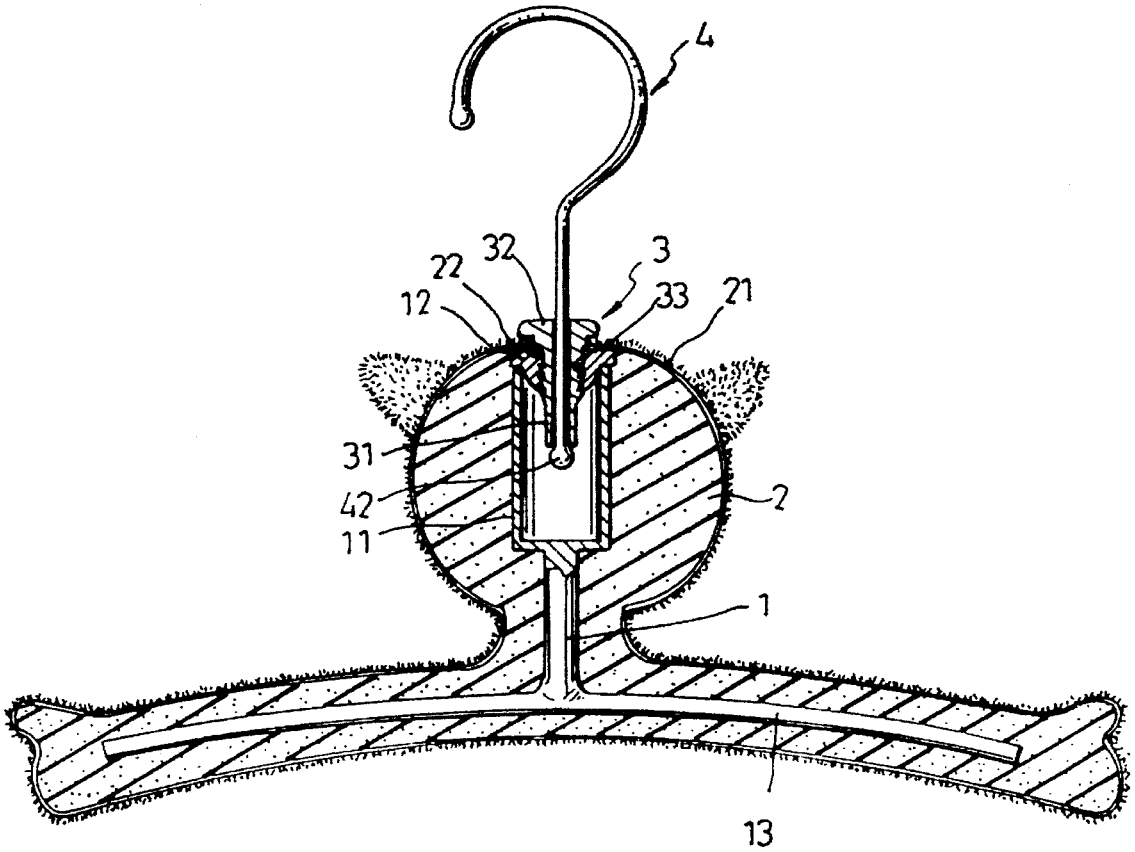
FIG. 2 is a sectional assembly view of the rotating clothes hanger shown in FIG. 1.

Referring to FIG. 2 and FIG. 1 again, the cap 12 is adhered to the top orifice of the receptacle 11, having a center mounting hole 15. The hook connector 3 is shaped like a headed bolt having a cylindrical bolt body 31, a head 32 at one end of the bolt body 31, threads 33 around the cylindrical bolt body 31, and a longitudinal center through hole 34 through the center of the head 32 and the longitudinal central axis of the bolt body 31. By inserting the cylindrical bolt body 31 through a hole 22 on the toy doll 2 and then forcing the cylindrical bolt body 31 into the center mounting hole 15 of the cap 12, the threads 33 are engaged with the bottom side of the periphery of the center mounting hole 15, and therefore the hook connector 3 is firmly secured to the cap 12. The swivel hook 4 has a straight mounting leg 41 at one end terminating in a rounded tip 42. The diameter of the rounded tip 42 is slightly bigger than that of the straight mounting leg 41 and the inner diameter of the longitudinal center through hole 34 on the hook connector 3. The swivel hook 4 is fastened to the hook connector 3 by forcing the rounded tip 42 of the straight mounting leg 41 into the longitudinal center through hole 34 of the hook connector 3, permitting the rounded tip 42 to be extended out of the bottom side of the cylindrical bolt body 31. When installed, the swivel hook 4 can be rotated within the longitudinal center through hole 34 of the hook connector 3, and the periphery 21 of hole 22 is firmly retained between the head 32 of the hook connector 3 and the cap 12 without hindering the rotation of the swivel hanger 4.

Figure 3:
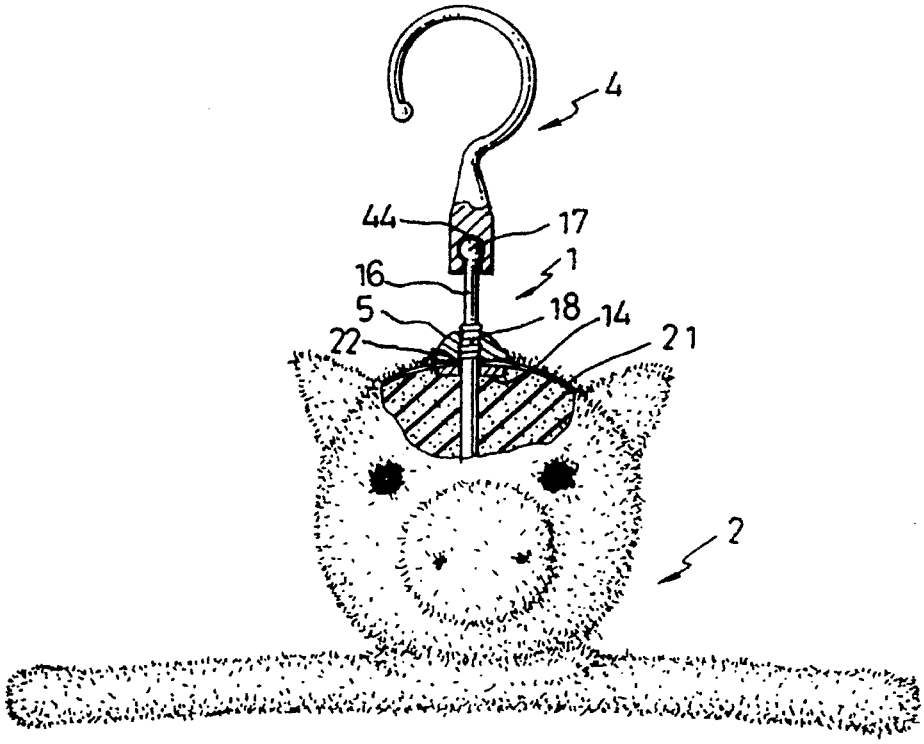
FIG. 3 shows an alternate form of the present invention with a part thereof in section.

FIG. 3 shows an alternate form of the present invention. This alternate form is comprised of a hanger base 1, a toy doll 2 covered on the hanger base 1, a coupling cap 5, and a swivel hook 4 rotatably connected to the hanger base 1. The hanger base 1 comprises a middle plate 14, a top extension rod 16 extended upwards from the middle plate 14 out of the hole 22 on the toy doll 2 and terminating in a ball 17, and a threaded coupling portion 18 connected between the middle plate 14 and the top extension rod 16. The coupling cap 5 is securely mounted around the threaded coupling portion 18 and covered on the hole 22 of the toy doll 2. The swivel hook 4 has a ball socket 44 at the bottom end rotatably coupled to the ball 17 on the top extension rod 16 of the hanger base 1.

Figure 4:
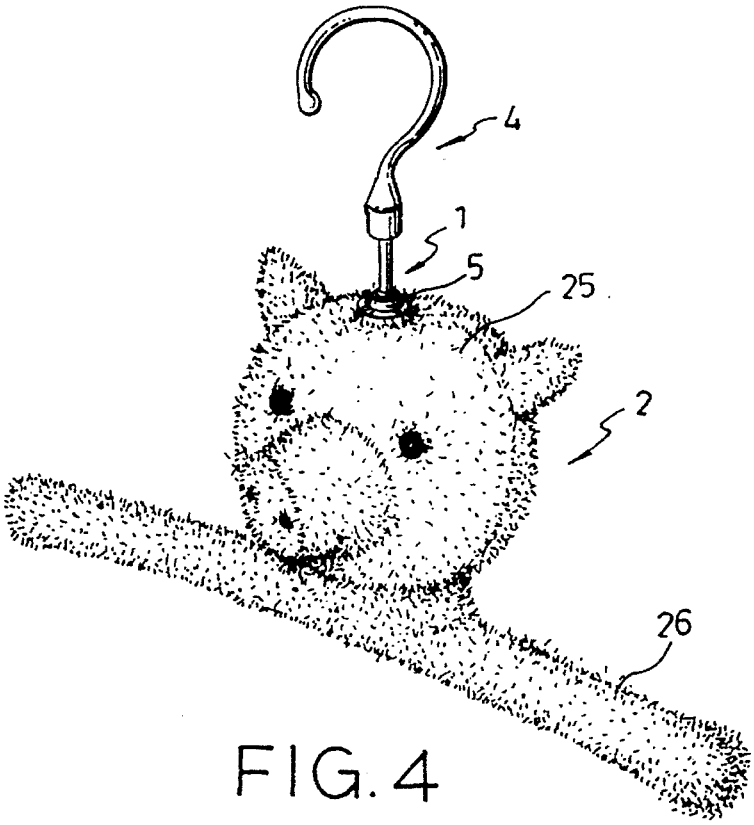
FIG. 4 is an elevational view of the alternate form of FIG. 3.

Referring to FIG. 4, the toy doll 2 comprises a head 25 shaped like the head of an animal (for example, a bear), and a body 26 covered over the horizontal rib (not shown) of the hanger base 1. The periphery of the hole 22 of the toy doll 2 is held down by the cap 5.

It is to be understood that the drawings are designed for purposes of illustration only, and are not intended as a definition of the limits and scope of the invention disclosed.

I claim:

1. A rotating clothes hanger comprising:

a hanger base having an elongated horizontal rib and a cylindrical receptacle perpendicularly extended from the mid point of said horizontal rib, said receptacle having a head with a hole;

a toy doll covered on said hanger base and having a hole at a top side thereof;

a hook connector fastened to said receptacle of said hanger base, said hook connector comprising a cylindrical bolt body fastened to the hole on the head of said receptacle, a head at one end of said bolt body stopped outside the head of said receptacle, and a longitudinal center through hole; and a swivel hook having a straight mounting leg terminating in a rounded tip, said straight mounting leg being inserted through the longitudinal center through hole on said hook connector, permitting said rounded tip to be engaged with said hook connector outside the longitudinal center through hole of said hook connector.

2. The rotating clothes hanger of claim 1 wherein said bolt body of said hook connector comprises at least one thread raised around the periphery and engaged with the head of said receptacle on the inside.

3. The rotating clothes hanger of claim 1 wherein the head of said receptacle of said hanger base is a cap fixedly secured to a top orifice on said receptacle.

4. A rotating clothes hanger comprising:

a hanger base having a middle plate, a horizontal rib and a vertical rib perpendicularly extended from the mid point of said horizontal rib, said vertical rib terminating in a top extension rod, said top extension rod terminating in a ball;

a toy doll covered on said hanger base, having a hole through which said top extension rod passes;

a coupling cap mounted around said top extension rod and covered on the periphery of the hole on said toy doll; and a swivel hook having a bottom end terminating in a ball socket coupled to said ball of said top extension rod.

5. The rotating clothes hanger of claim 4 wherein said hanger base further comprises at least one thread raised around a connection area between said middle plate rib and said top extension rod for engagement with said cap.

* * * * *